US009550354B2

(12) United States Patent
Poissant et al.

(10) Patent No.: US 9,550,354 B2
(45) Date of Patent: Jan. 24, 2017

(54) METHOD AND A SYSTEM FOR CLEANING PRINTING PARTS

(71) Applicant: Pad Peripheral Advanced Design, Inc., St-Bruno-de-Montarville (CA)

(72) Inventors: Daniel Poissant, Mont Saint-Hilaire (CA); Anton Chernyshov, St-Bruno-de-Montarville (CA); Martin Gingras, Brossard (CA); Eric Thibeault, Longueuil (CA)

(73) Assignee: Pad Peripheral Advanced Design, Inc., St-Bruno-de-Montarville (CA)

( * ) Notice: Subject to any disclaimer, the term of this patent is extended or adjusted under 35 U.S.C. 154(b) by 0 days.

(21) Appl. No.: 14/396,996

(22) PCT Filed: Mar. 13, 2013

(86) PCT No.: PCT/CA2013/050187

§ 371 (c)(1),
(2) Date: Oct. 24, 2014

(87) PCT Pub. No.: WO2013/159213

PCT Pub. Date: Oct. 31, 2013

(65) Prior Publication Data

US 2015/0068558 A1 Mar. 12, 2015

Related U.S. Application Data

(60) Provisional application No. 61/638,701, filed on Apr. 26, 2012.

(51) Int. Cl.
*B08B 3/00* (2006.01)
*B41F 35/00* (2006.01)
(Continued)

(52) U.S. Cl.
CPC ..... *B41F 35/00* (2013.01); *B05B 15/00* (2013.01); *B08B 3/024* (2013.01); *B08B 5/02* (2013.01);
(Continued)

(58) Field of Classification Search
CPC ..... B08B 3/00; B08B 3/02; B08B 3/04; B08B 5/00; B08B 5/02; B08B 3/024; B08B 2230/01; B41F 35/00; B41F 35/001; B41F 35/02; B41F 35/04; B41L 41/00; B41N 3/006; B41N 3/06; B05B 15/00; B41P 2235/26; B41P 2235/27; B41J 29/17; C11D 11/0041
See application file for complete search history.

(56) References Cited

U.S. PATENT DOCUMENTS 2,543,663 A * 2/1951 Marsden ..... B41F 7/30 101/147
3,656,493 A 4/1972 Black
(Continued)

FOREIGN PATENT DOCUMENTS

DE 102008035284 A1 2/2010
JP 2008256197 A 9/2006
WO WO-9746388 A1 12/1997

OTHER PUBLICATIONS

European Search report for EP 13781157 dated Oct. 23, 2015 (5 pages).

(Continued)

*Primary Examiner* — Bibi Carrillo
*Assistant Examiner* — Sharidan Carrillo
(74) *Attorney, Agent, or Firm* — Locke Lord LLP; Howard M. Gitten

(57) ABSTRACT

A system and a method for cleaning a printing cylinder or other printing equipment such as printing plates, ink pans or
(Continued)

floors of printing units, the method comprising applying a detergent to the surface to be cleaned, after a period to allow action of the detergent, removing the detergent by rinsing, using a vapor and high velocity air stream, i.e. atomized water fog; or steam; or a combination of steam and air, which allows dislodging particles encrusted within cells of the surface of the piece of equipment to be cleaned.

6 Claims, 9 Drawing Sheets

(51) Int. Cl.

| | |
|---|---|
| ***B41N 3/06*** | (2006.01) |
| ***B41J 29/17*** | (2006.01) |
| ***B41N 3/00*** | (2006.01) |
| ***B41F 35/02*** | (2006.01) |
| ***B41F 35/04*** | (2006.01) |
| ***B08B 5/02*** | (2006.01) |
| ***B05B 15/00*** | (2006.01) |
| ***C11D 11/00*** | (2006.01) |
| ***B41L 41/00*** | (2006.01) |
| *B08B 3/02* | (2006.01) |
| *B08B 3/04* | (2006.01) |
| *B08B 5/00* | (2006.01) |

(52) U.S. Cl.

CPC ..... *B41F 35/001* (2013.01); *B41F 35/02* (2013.01); *B41F 35/04* (2013.01); *B41J 29/17* (2013.01); *B41L 41/00* (2013.01); *B41N 3/006* (2013.01); *B41N 3/06* (2013.01); *C11D 11/0041* (2013.01); *B08B 3/00* (2013.01); *B08B 3/02* (2013.01); *B08B 3/04* (2013.01); *B08B 5/00* (2013.01); *B08B 2230/01* (2013.01); *B41P 2235/26* (2013.01); *B41P 2235/27* (2013.01)

(56) References Cited

U.S. PATENT DOCUMENTS

| | | | | |
|---|---|---|---|---|
| 5,490,460 | A * | 2/1996 | Soble | B41F 35/001 101/423 |
| 6,561,096 | B1 | 5/2003 | Munz | |
| 6,706,337 | B2 * | 3/2004 | Hebert | B05B 17/0623 101/450.1 |
| 2003/0167948 | A1 * | 9/2003 | Weitz | B41F 35/04 101/425 |
| 2003/0178048 | A1 | 9/2003 | Honkala et al. | |
| 2005/0066830 | A1 * | 3/2005 | Miyagawa | B41C 1/1083 101/463.1 |
| 2006/0266242 | A1 * | 11/2006 | Bartesaghi | B41F 35/06 101/425 |
| 2007/0175348 | A1 * | 8/2007 | Petri | B41F 35/00 101/424 |
| 2015/0068558 | A1 * | 3/2015 | Poissant | B41N 3/06 134/30 |

OTHER PUBLICATIONS

International Search Report for PCT/CA2013/050187 dated May 30, 2013.

Written Opinion of the International Searching Authority dated May 29, 2013.

German Office Action dated Jun. 12, 2015 for German Application No. 11 2013 002 207.9.

* cited by examiner

METHOD AND A SYSTEM FOR CLEANING PRINTING PARTS

CROSS-REFERENCE TO RELATED APPLICATIONS

This application is a U.S. National Entry Application of PCT Application No CA2013/050187 filed on Mar. 13, 2013 and published in English under PCT Article 21(2), which itself claims benefit of U.S. Provisional Application Ser. No. 61/638,701, filed on Apr. 26, 2012, the entire contents of the aforementioned applications are hereby incorporated herein by reference.

FIELD OF THE INVENTION

The present invention relates to printing equipment. More specifically, the present invention is concerned with a method and a system for cleaning printing parts using vapor.

BACKGROUND OF THE INVENTION

Printing cylinders and plates are standardly cleansed manually, by applying a solvent or a detergent that acts on the matter to be eliminated from the cylinders, followed by a mechanical action aiming at removing particles from the cylinders, rinsing with a chemically compatible product and optional drying to prevent formation of a deposit or ring-marks.

Another method uses pressurised air and a gun projecting a material such as sodium bicarbonate or plastic beads for example, so as to remove the matter from the cylinders. Such method generates solid residues that are contaminated by pigmentation and resin, as well as dust, which need be dealt with during the process and disposed of thereafter. Dust may cause damages to surrounding mechanical systems such as ball bearings. The method may be performed on a printing machine or in a workshop, by an operator pointing the gun to the cylinder to be cleansed and linearly displacing K. Safety equipment is necessary for assured respiratory and physical protection the operators. This method is very slow and can mobilize an operator for periods over one hour. Otherwise, an automated gun may be used, moved by a conveyer, and the method is performed within a chamber. The management of dust is thus largely facilitated by the fact that the operation is carried out in a hermetic chamber generally equipped with ventilation system and dust filters. This automated method offers also the advantage of offering very constant results.

In still another method, ultrasonic waves are used to detach the matter from the cylinders in a cleaning bath, typically comprising a warm detergent. This method has been shown to damage the surface of the cylinders if repeatedly used, especially surfaces covered with ceramic. In case of surfaces of steel covered with a fine layer of ceramics, since ceramics and steel have different expansion coefficients, microscopic cracks may be created.

Another method comprises applying a cleaning fluid, such as a detergent, on the surface to be cleansed, and removing it after a delay by rinsing with pressurised water, which allows dislodging particles encrusted within the cells of the surface of the cylinder. However, such method produces large quantity of contaminated water, which must then be treated to neutralize the detergent therein, and the residual waste usually remains contaminated with pigments and other resins. The method may be performed on a printing machine or in a workshop. After the detergent has been applied, an operator points a pressurized water gun to the cylinder to be cleansed and linearly displaces the gun thereover. Vacuum systems may be connected to the gun to monitor spatters and recover contaminated water. The method may also be performed in a chamber, using automated application of detergent and an automated gun. Using a chamber largely facilitates monitoring the spatters and recovering used waters. This automated method offers also the advantage of offering very constant results.

SUMMARY OF THE INVENTION

More specifically, in accordance with the present invention, there is provided a method for cleaning printing parts, comprising applying a detergent to the surface of the part; and rinsing using a vapor and high velocity air stream, steam or a combination of steam and air.

There is further provided a system for cleaning printing part, comprising a detergent source, an air source; a steam source and/or a water source; and at least one head assembly connected to the detergent source, the air source and the steam source and/or the water source.

Other objects, advantages and features of the present invention will become more apparent upon reading of the following non-restrictive description of specific embodiments thereof, given by way of example only with reference to the accompanying drawings.

BRIEF DESCRIPTION OF THE DRAWINGS

In the appended drawings;

FIG. 7 *b*) shows a unit for generating water fog in the system of FIG. 7*a*), according to an embodiment of an aspect of the present invention;

DESCRIPTION OF EMBODIMENTS OF THE INVENTION

In the following, "steam" is used to refer to water above boiling point that is allowed to escape as gas. It only exists at above water's boiling point at a given pressure (100+ degrees C. at sea level). It comprises water molecules bouncing around like a gas. "Vapor" is used to refer to diffused water particles, i.e., an atomized aqueous solution, like fog or mist. It comprises air molecules with small water particles floating in it. It exists at temperatures/pressures below boiling point. When the water particles are condensed, the vapor appears as a fog, when they are totally evaporated the vapor is invisible.

Figure 1:
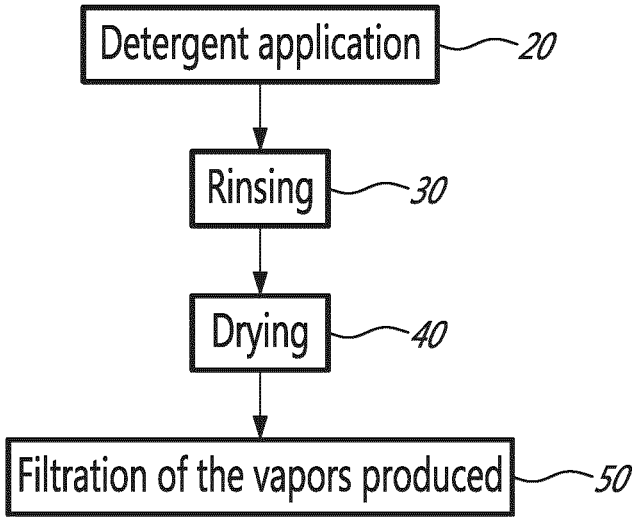
FIG. 1 is a flowchart of a method according to an embodiment of an aspect of the present invention.
Figure 2:
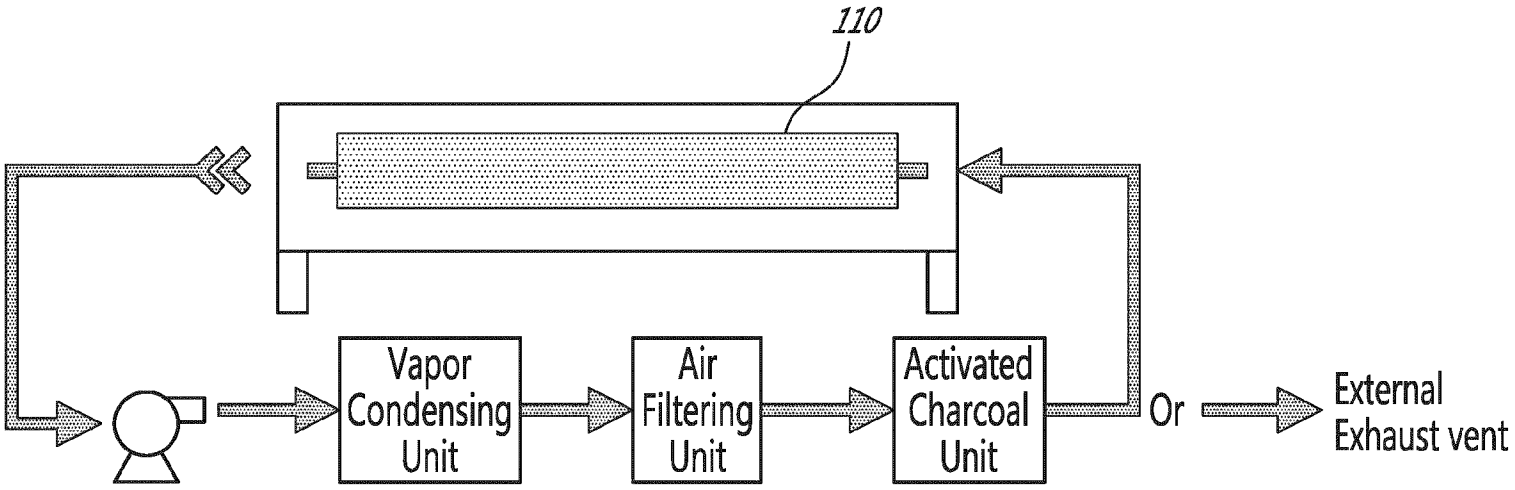
FIG. 2 is a schematic view of step 50 of the method of FIG. 1

In a method according to an embodiment of an aspect of the present invention illustrated in FIG. 1, a detergent is applied to the surface of a printing cylinder or other printing equipment such as printing plates, ink pans or floors of printing units to be cleaned (step 20). After a period to allow action of the detergent, the detergent is removed by rinsing, using a vapor and high velocity air stream, i.e. atomized water fog; or steam; or a combination of steam and air (step 30), which allows dislodging particles encrusted within cells of the surface of the piece of equipment to be cleaned.

The method may be applied on a printing machine or in a workshop or in a chamber also called cabinet. Once the cycle of application of the detergent (step 20) is over, an operator points a gun equipped with a vapor and high velocity air stream head assembly, or a steam only head assembly towards the equipment to be rinsed, and moves it in a linear way, in order to prevent marks.

When the method is performed in a cabinet, the application of the detergent (step 20) and the rinsing (step 30) may be automated. In step 30, the management of steam and/or of fumes, i.e. steam comprising solid and liquid particles of detergent and/or ink and/or resin dislodged from the surface of the piece of equipment, is then facilitated owing to the fact that the operation is carried out in a closed environment and the method, being automated, allows very constant results.

When operating in a cabinet, using a same head assembly for applying the detergent in step 20 and for rinsing in step 30 is found to be advantageous, compared to using two separate tools, i.e. one for applying the detergent (step 20) and one for rinsing (step 30). Using a multipurpose head allows controlling the application of the detergent with accuracy and uniformity (step 20). During step 20, the displacement speed of the head assembly may be controlled by an automated mechanism, the flow of detergent being a function of the pressure of a feed pump. In a possible embodiment, a simple aspiration vortex, created by an air stream or in a pressurized vessel, is used instead of a detergent feed pump, which pumps the detergent and projects it on the surface to be cleaned.

In step 30, exclusive use of steam was shown to be effective for dislodging particles separated from the surface of the surface to be cleaned under action of the detergent in step 20.

The efficiency of steam is found to be related to its velocity. Using steam in step 30 may cause a rise of the temperature of the surface of the piece of equipment being processed. This rise in temperature may be beneficial, as it contributes to the melting of the ink to be removed. However, a rise in temperature may damage the surface, especially in cases of cylinders made of a steel core coated by a thin ceramic layer, or of hollow cylinders of the sleeve type for example.

When dealing with such delicate surfaces, in order to prevent formation of cracks, steam may be combined with a controlled air stream to allow an accurate control of the temperature of the steam and of its speed of projection. The action of the air stream is two-fold: it decreases the temperature of the steam and increases the velocity of the steam jet. In cases of high velocity steam jets and when the rising of the temperature of the surface being processed is not an issue, an air steam is not necessary.

Instead of combining air with steam so as to control the temperature, the piece of cylinder or the piece being processed may be cooled down prior to submitting to the steam jet using a cryogenic unit for example, or while or immediately after it is submitted to the steam, using ventilators providing very cold air for example. Still alternatively, the steam may be passed through a heat sink immediately before being directed to the surface to be rinsed (see FIG. 9) so as to cool its temperature down at the last minute before it impacts the surface of the piece being processed, so that it does not lose its efficiency while not delivering so much heat to the surface.

Steam may be avoided altogether, and replaced by a stream of vapor and high velocity air, i.e. atomized water or water fog, using a water gun connected to compressed air for example, allowing spraying a high velocity air stream combined with a low water flow rate, for example of about 0.0315 liter/minute, on the piece to be rinsed. The water fog is mainly pressurized, i.e. typically between 60 and 100 psi, into the high velocity air stream, providing humidity content in a range between about 50% and about 100% in air under pressure, adjustable using a needle valve. The humidity of this pressurized air allows dislodging the detergent from the piece being rinsed while minimizing the amount of water used and therefore of used water generated, as the detergent is vaporized under the action of the incoming pressurized air. In case of a vapor and high velocity air stream head assembly, the head assembly may be combined with an aspiration system, which allows managing the fumes during the operation.

Rinsing may be performed in two directions along the x axis (see FIG. 4), in order to remove microscopic deposits on the walls of the cells of the surface opposite the head angle. By thus rinsing once in a direction and then in the opposite direction, a uniform performance of the rinsing step is achieved.

In a further step 40, a concentric dry air blast may be used for drying the surface, by quickly eliminate moisture and dislodging particles which may have remained in place during the rinsing step 30.

An optional step 50 of filtration of the fumes and/or vapors produced may be contemplated, using an aspiration system which condensates the vapors, collects solid particles, such as pigments or resins, in suspension in the air, and retrieves odors and volatile organic compounds (VOCs) in an activated carbon filter. Air may then be recycled in the system or evacuated according to standard environmental policies (see FIGS. 2, 5-7, 9).

Figure 3A:
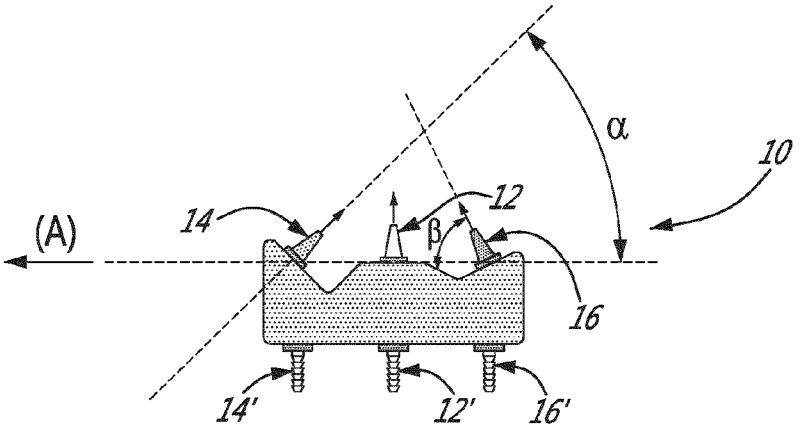
FIG. 3 shows schematic views of head assemblies according to embodiments of an aspect of the present invention: *a*) and *a'*) section of bi-directional head assemblies and *b*) section of a reversible head assembly.
Figure 3A:
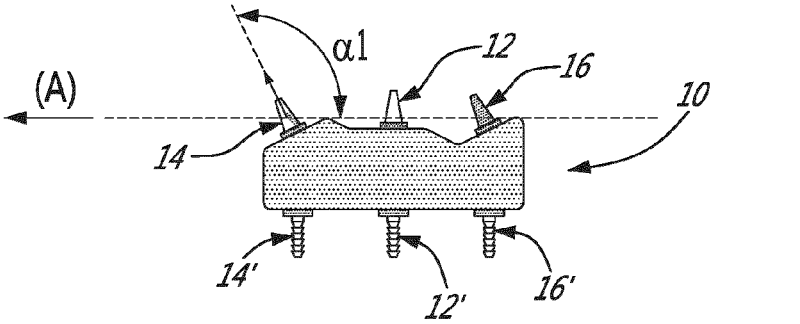
Figure 3B:
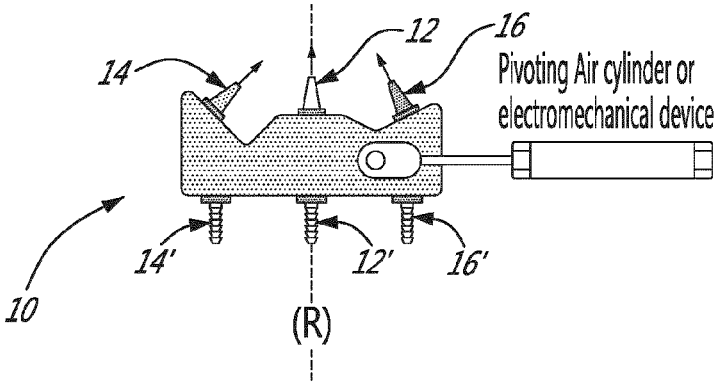

FIGS. 3*a* and 3*a*' show bi-directional head assemblies and FIG. 3*b* shows a reversible head assembly, according to embodiments of an aspect of the present invention, in case of vapor/air combination.

The illustrated head assembly 10 comprises a detergent nozzle 12, a rinsing nozzle 14 and a drying nozzle 16, fed by respective detergent inlet 12', steam/air inlet 14' and drying air inlet 16'.

Tests were carried out to assess the effect of the variation of the geometry of the rinsing nozzle 14, the speed of the projection of the air by the rinsing nozzle 14, the jetting angle of the rinsing nozzle 14, the distance between the drying nozzle 16 and the rinsing nozzle 14, the rate of travel of the head assembly 10, the temperature of the air projected by the drying nozzle 16, the use of a very dry gas such as nitrogen for example for projection by the drying nozzle 16.

A rate of travel of the head assembly 10 in a range comprised between 0 and 2 m/s was found effective.

An orientation of the detergent nozzle 12 of about 90° relative to the direction of displacement of the head assembly 10 was found to allow detergent dispersion uniformly around a target area on the surface of the cylinder or plate.

The rinsing nozzle 14 allows controlling the temperature of steam and of an air-steam ratio. Tests were done on the effect of the angle of the rinsing nozzle 14 relative to the longitudinal axis of the surface to be cleaned. It was found that an angle α in a range between about 30° and about 60°, for example of about 45°, relative to the direction opposite the direction of displacement of the head 10 (see arrow A) allowed an optimal cleaning performance (see FIG. 3*a*).

When the rinsing nozzle 14 was tilted in the direction of displacement (see for example FIG. 3*a*'), the air/steam stream tended to decrease the performance of the detergent by diluting the detergent due to the condensation of the steam upstream of the rinsing nozzle, which was also observed, at a lesser degree, when the rinsing nozzle 14 was positioned perpendicularly to the direction of displacement. However, a configuration with the rinsing nozzle 14 at an angle α' toward the direction of displacement of the head 10 (see FIG. 3*a*') is possible if needed, since it was demonstrated that the air/steam rinsing step allowed overcoming a reduction in performance of the detergent due to steam condensation.

A drying nozzle 16 oriented at an angle β comprised between about 40° and about 60° relative to the direction of displacement of the head assembly 10, for example at about 45° relative to the direction of displacement of the head assembly 10, toward the head displacement direction (see FIG. 3), was found to allow a quick and efficient drying of the cylinder, and to allow the drying nozzle 16 to act as a wiper preventing the vapor stream from projecting unwanted residues towards already cleaned areas of the cylinder or plate.

In the case of a reversible head assembly, as illustrated in FIG. 3*b* for example, a pivoting air cylinder or electromechanical device allows pivoting the head assembly about a rotating axle (R).

This head assembly allows application of the detergent (step 20), rinsing (step 30), and drying the surface (step 40).

The head assembly may be provided with a detent allowing starting the rinsing nozzle 14 and the drying nozzle 16. The detent controls pistons of a manifold integrated to the head assembly, which is resistant to the pressure and temperature of steam, thereby allowing control of the nozzles without recurring to electrical power.

Figure 4:
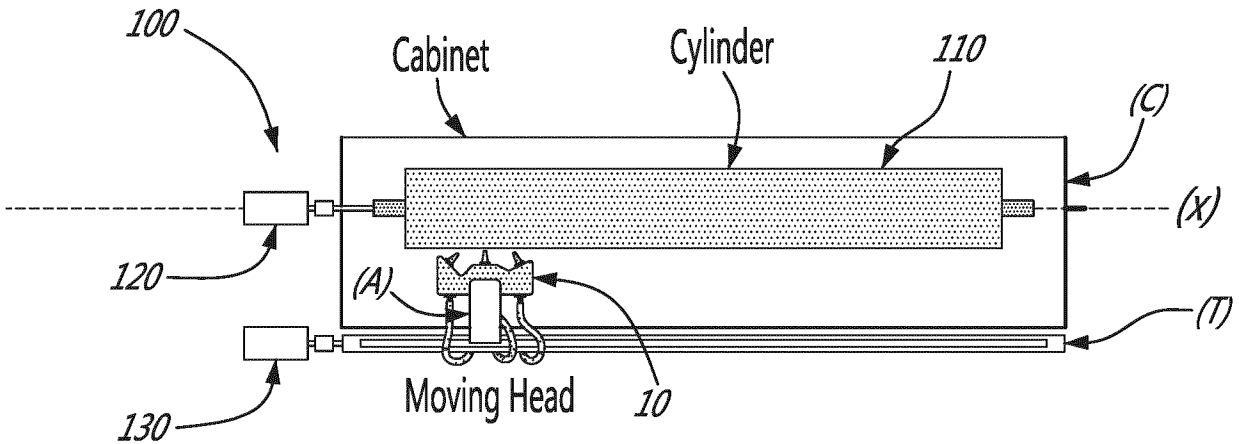
FIG. 4 is a schematic view of a unit according to an embodiment of an aspect of the present invention.

FIG. 4 shows an automation unit 100 according to an embodiment of an aspect of the present invention for a printing cylinder. It comprises a support for a cylinder 110 to be cleaned, which may be of varying diameter and length and has a weigh of typically more than 300 kg, even if a sleeve type cylinder may be used, i.e. hollow and lighter. The support is connected to a unit 120 controlling rotation, acceleration, and braking of the cylinder 110, as well as numerical positioning which allows an operator, through a control panel (not shown), to activate rotation of the cylinder 110 to a desired position for inspection or maintenance for example.

In a cabinet (C), the multipurpose head assembly 10 moves along the cylinder 110 without ever coming into contact with the cylinder 110, on a transport mechanism, belt or a screw, or multipurpose head assembly 10 may be self-driven on a rail for example, which allows accurate motion of the multifunction head 10. To improve reliability, tracks (T) may be installed outside of the cabinet (C), with an extension arm (A) penetrating therein by and opening window. The multifunction head is then installed on the extension arm (A) inside the cabinet (C). Displacement of the head assembly 10 is controlled by a precision unit 130 driven by a step motor and controlled with a position encoder. The unit 130 allows controlling the starting point, the end of travel as well as the displacement speed and acceleration of the head assembly 10. The displacement speed may be adjusted according to the porosity of the surface of the cylinder 110, of the type of ink to be removed from the cylinder 110, and/or of the temperature of the rinsing jet. These adjustments may be stored in the memory of the control panel.

The unit 120 combined with the unit 130 may also allow to select a working section for the head 10, delimited by part of the diameter and of a determined length of the cylinder 110. Using automation, the movement of the head assembly 10 can be synchronized and turned on and off as the cylinder is in rotation, which allows an accurate control of the section to be cleaned. The rotation speed may be adjusted according to the diameter of the cylinder 110 to allow a constant cleaning speed of the head assembly 10 around the cylinder depending on its diameter. The rotation speed may also be adjusted according to the porosity of the surface, of the type of ink to be cleansed off the cylinder or the temperature of the rinsing jet flow. These adjustments may be stored in the memory of a control panel.

Figure 5:
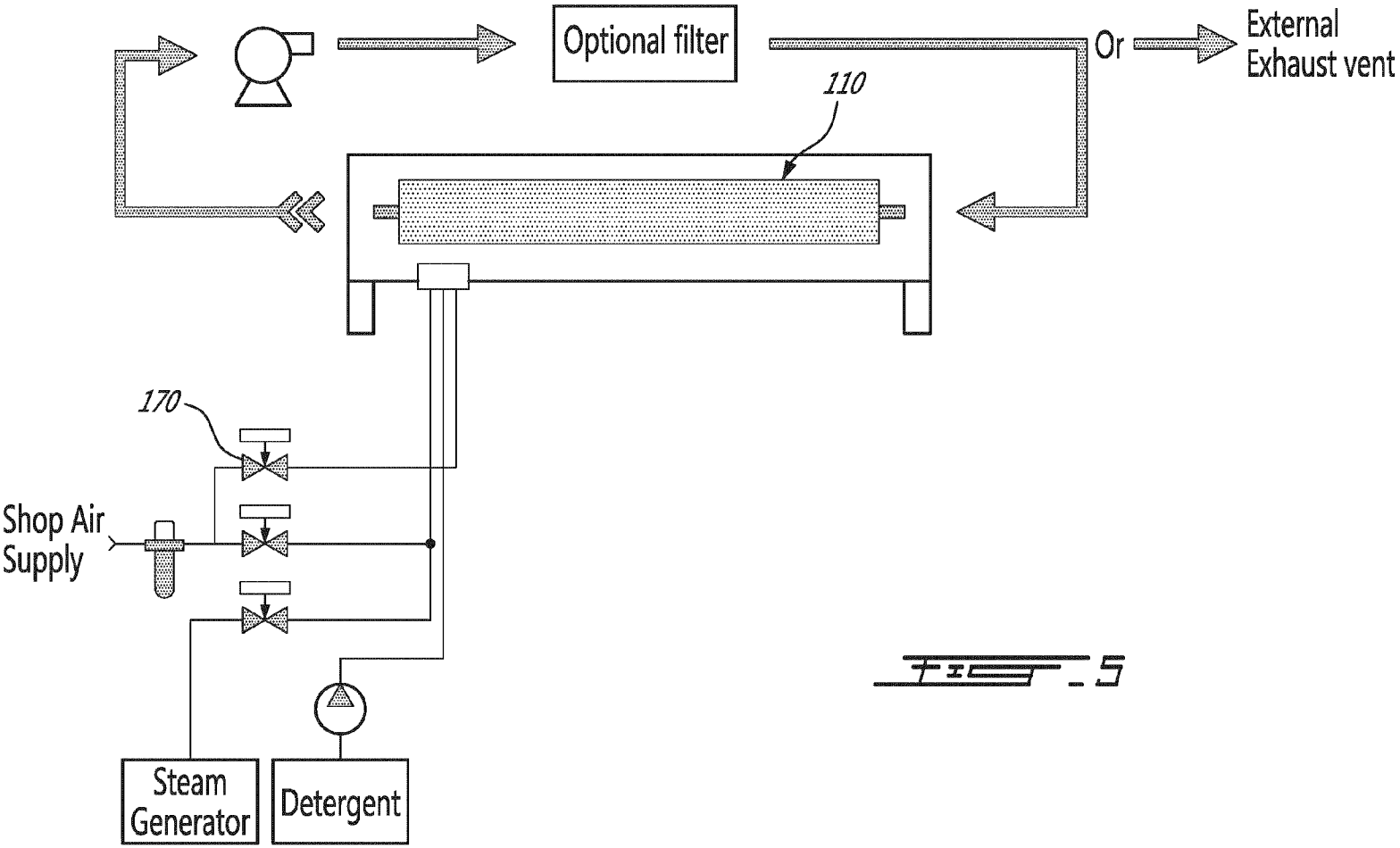
FIG. 5 is a schematic view of a system according to an embodiment of an aspect of the present invention.
Figure 6:
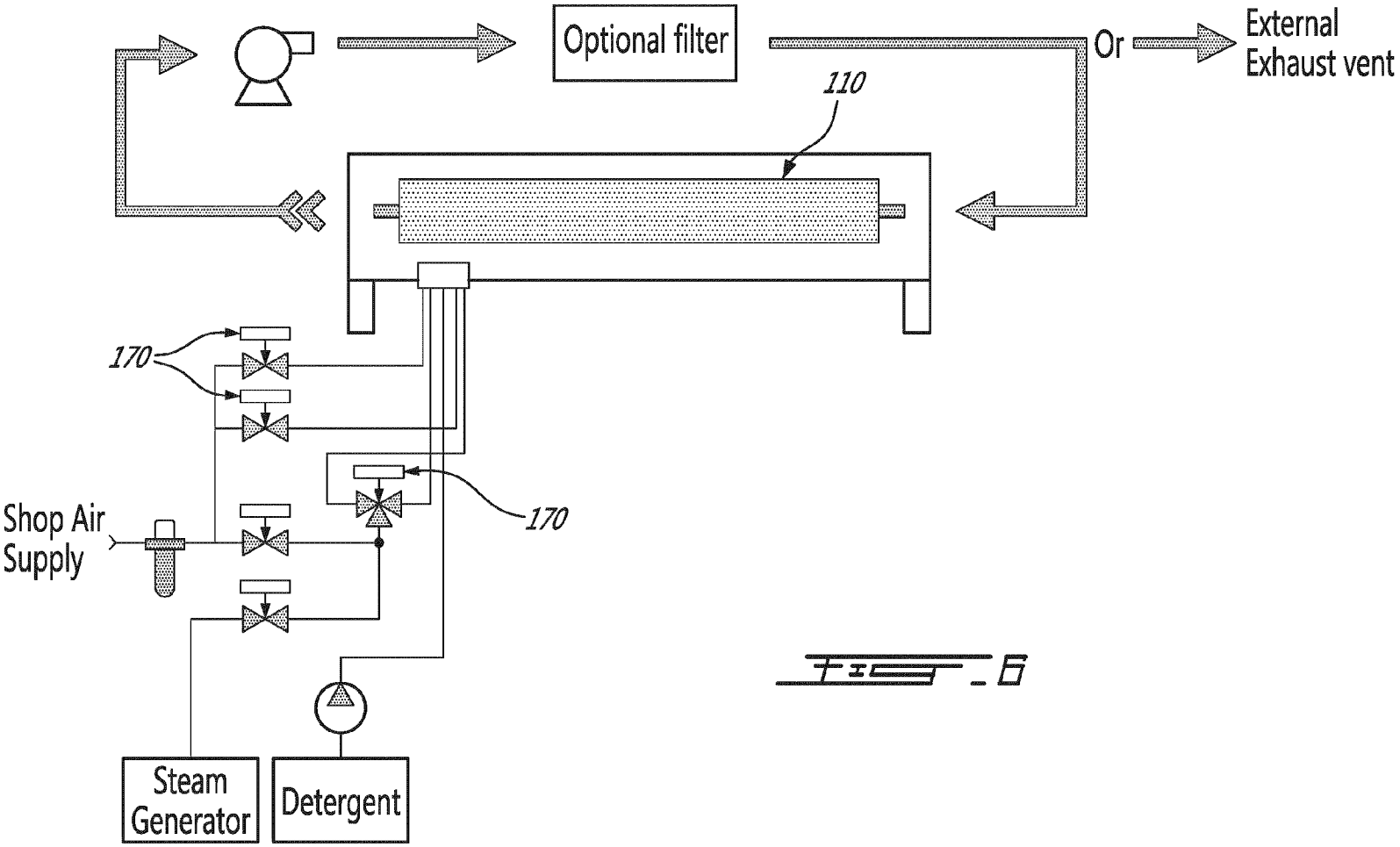
FIG. 6 is a schematic view of a system according to an embodiment of an aspect of the present invention.

FIG. 5 shows a system comprising the unit of FIG. 4. The multipurpose head 10 may be allowed to swivel at the end it course to carry out a return cycle. In the case of a bidirectional head as illustrated for example in FIG. 3*a*, a circuit of valves 170 allows a fluid transfer to a second set of nozzles to carry out the return cycle (see FIG. 6).

Figures 7A, 7B:
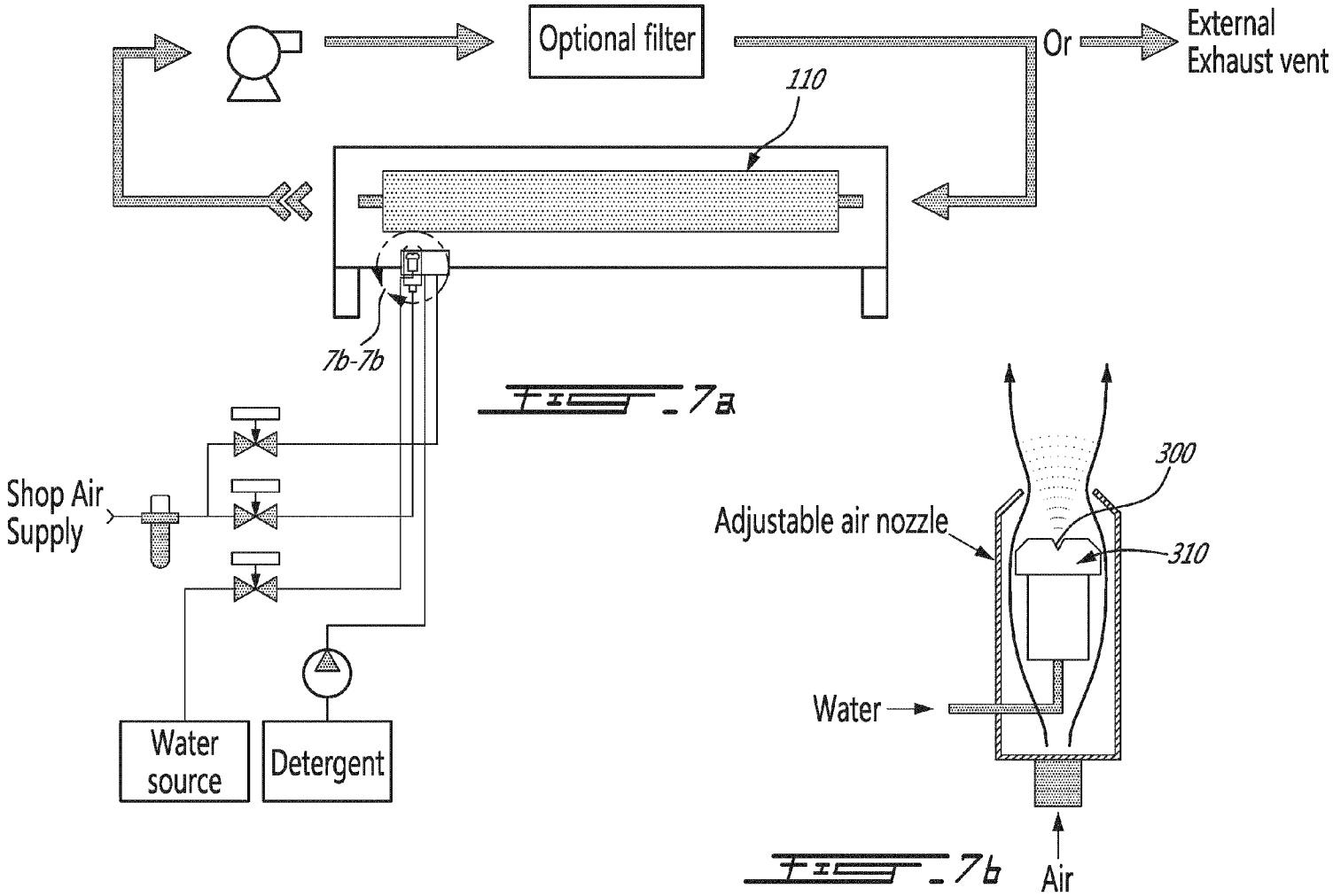
FIG. 7 *a*) is a schematic view of a system according to an embodiment of an aspect of the present invention.

FIG. 7*a* shows a system comprising the unit of FIG. 4 in case of using a vapor and high velocity air stream, i.e. atomized water fog in step 30, where the atomized water is injected in the main air stream for example. A unit for generating atomized water fog is shown in insert (FIG. 7*b*). Water is forced through a reduced outlet aperture 300 of a water atomizer 310. The size of the water droplets produced is controlled by adjusting the ratio between the pressure submitted to the water and the size of the outlet aperture 300.

The control panel is an operator interface connected to a programmable controller. The programmable controller monitors synchronization of the different displacement motors, the opening and the closing of valves, and other programmable or manual functions necessary to the operation of the system. Instead of a separate programmable controller, it is also possible to have only one interface for controlling all inputs and outputs of the system.

Figure 9:
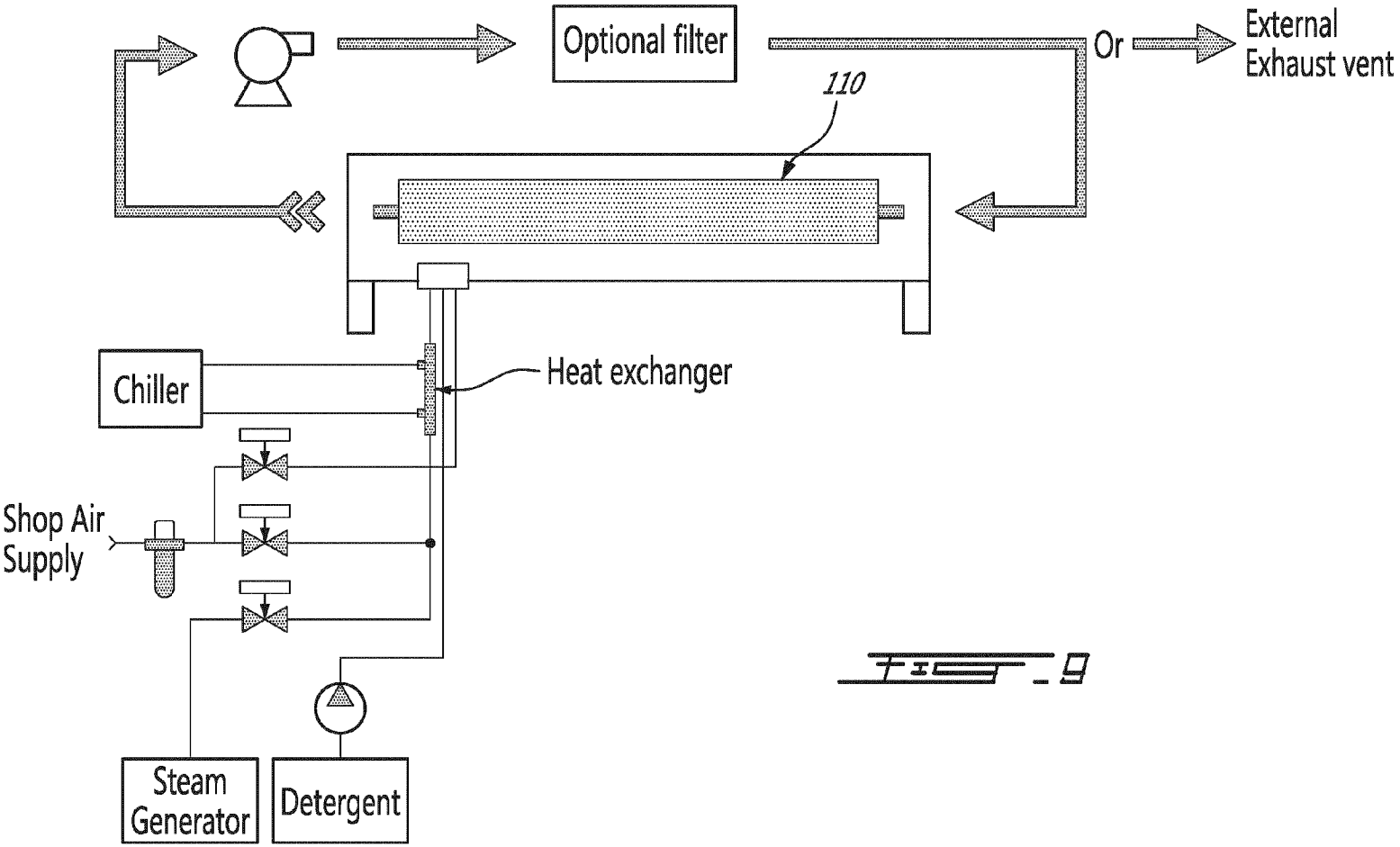
FIG. 9 is a schematic view of a system according to an embodiment of an aspect of the present invention.

In an embodiment of the present invention, a steam nozzle is used and, in case the temperature of the piece of equipment being processed needs to be controlled to avoid damage thereof, an independent cooling unit is used, as discussed hereinabove (see FIG. 9). Still alternatively, a same nozzle may be used for providing steam and air.

Figure 8:
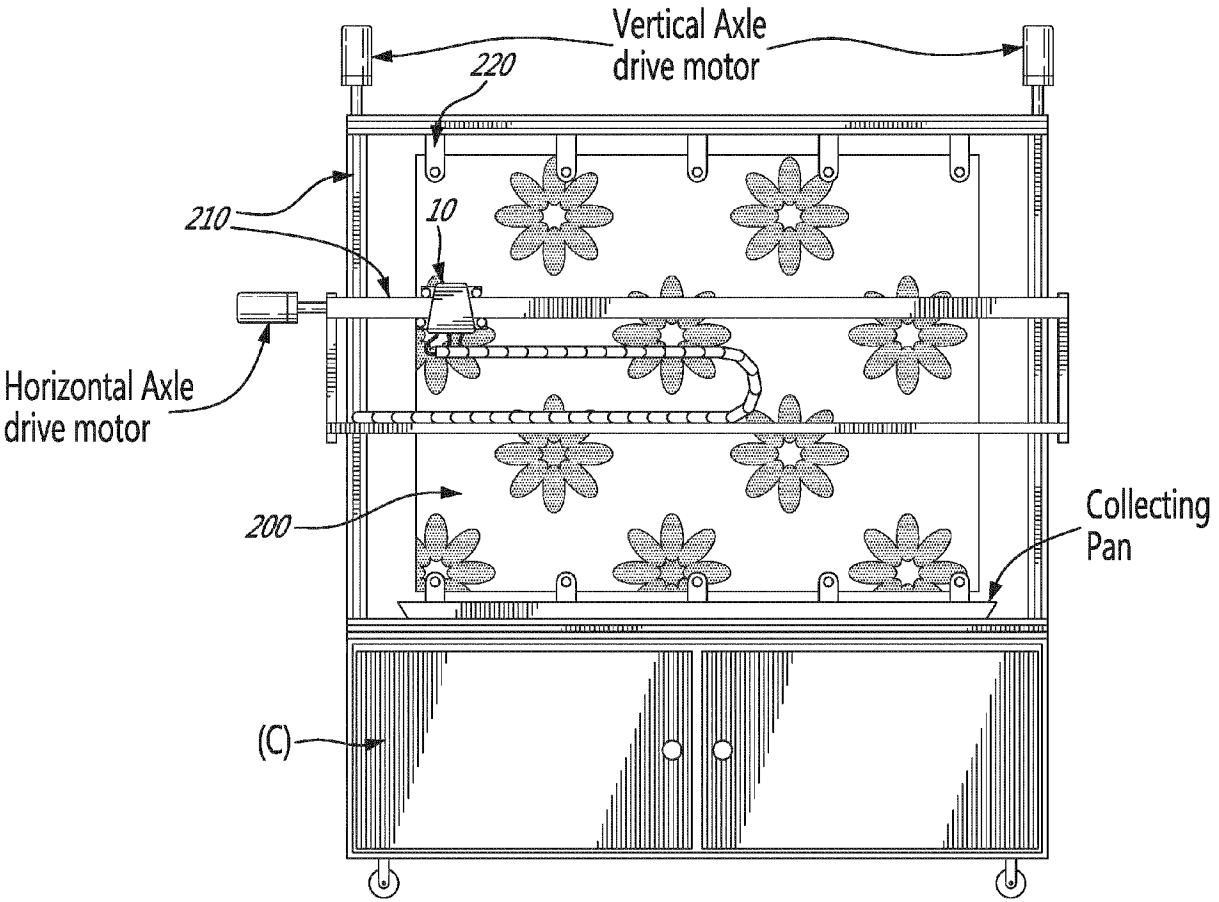
FIG. 8 is a schematic view of a unit according to an embodiment of an aspect of the present invention.

The present method and system may be used to clean printing plates. Typically made in metal, plastic, rubber, paper, polymers or photopolymers for example, printing plates are attached to a cylinder in the press, and transfer an image to paper or other substrates. For cleaning a printing plate 200, once unwrapped from the cylinder, the plate may be hung on a gantry 210 by plate supports 220, and the assembly head 10 operated to move thereabout vertically (top to bottom) and horizontally (left-right) so as to wash it over (see FIG. 8). It may also be contemplated applying the detergent on the plate 200 first supported on a horizontal gantry, and then hanging the plate vertically for the rinsing step. For printing plates that are not removable from the cylinders, they may be cleaned as described hereinabove in relation to cylinders.

The present method and system combine the use of a cleaning product, such as a detergent, and rinsing using vapor, i.e. atomized water fog, steam or a combination of steam and air steam.

As people in the art will appreciate, the present method and system allow precise control of the cleaning and of the use of consumable detergent. The method and the system for cleaning printing cylinders, such as anilox cylinders or rotogravure cylinders, as well as printing plates, ink pans and other printing equipment, combine speed of execution, minimized energy chain and use of water, based on using water droplets, water steam or a combination of water steam and air stream.

The scope of the claims should not be limited by the embodiments set forth in the examples, but should be given the broadest interpretation consistent with the description as a whole.

What is claimed is:

1. A method for cleaning printing parts, comprising:

i. applying a detergent to a surface of the part; and ii. after a period of action of the detergent on the surface of the part, removing the detergent by rinsing the surface of the part using a stream of vapor at a temperature below the boiling point of water;

iii. wherein said stream of vapor has a pressure in a range between about 60 and about 100 psi and a humidity content in a range between about 50% and about 100%.

2. The method of claim 1, further comprising drying the part.

3. The method of claim 1, comprising using a head assembly both for said applying the detergent and for said rinsing.

4. The method of claim 1, wherein said stream of vapor is being produced using an air compressor and a water gun.

5. The method of claim 1, wherein said rinsing is performed in two directions along an x axis of the part.

6. The method of claim 1, wherein the printing part is one of: a cylinder, a printing plate and an ink pan.

* * * * *